US008342185B2

(12) United States Patent
Egued

(10) Patent No.: US 8,342,185 B2
(45) Date of Patent: Jan. 1, 2013

(54) TWIN CHAMBER HUMIDIFYING TUBE

(75) Inventor: Nelson Alfonso Egued, Madrid (ES)

(73) Assignee: Nelson Alfonso Egued, Madrid (ES)

( * ) Notice: Subject to any disclaimer, the term of this patent is extended or adjusted under 35 U.S.C. 154(b) by 281 days.

(21) Appl. No.: 12/958,108

(22) Filed: Dec. 1, 2010

(65) Prior Publication Data

US 2011/0067713 A1 Mar. 24, 2011

Related U.S. Application Data

(63) Continuation-in-part of application No. 12/046,927, filed on Mar. 12, 2008, now abandoned.

(30) Foreign Application Priority Data

Nov. 27, 2007 (ES) ..... 200703151

(51) Int. Cl.
*A24F 13/00* (2006.01)
*A24B 1/02* (2006.01)

(52) U.S. Cl. ..... 131/329; 131/300; 131/250; 206/213.1; 312/31

(58) Field of Classification Search ..... 131/329, 131/300, 250; 206/213.1; 312/31
See application file for complete search history.

(56) References Cited

U.S. PATENT DOCUMENTS

| | | | | |
|---|---|---|---|---|
| 2,161,816 | A | 6/1936 | Jacobstein | |
| 5,957,277 | A * | 9/1999 | Elliott | 206/205 |
| 6,112,889 | A * | 9/2000 | Wicker | 206/213.1 |
| 6,290,059 | B1 | 9/2001 | Chuan | |
| 2007/0163608 | A1 * | 7/2007 | Tarlow | 131/240.1 |

FOREIGN PATENT DOCUMENTS

| | | |
|---|---|---|
| ES | 1000746 | 3/1988 |
| ES | 1042493 | 9/1999 |

* cited by examiner

*Primary Examiner* — Richard Crispino
*Assistant Examiner* — Dionne Walls Mayes
(74) *Attorney, Agent, or Firm* — Patterson Thuente Christensen Pedersen, P.A.

(57) ABSTRACT

The present document describes a twin-chamber humidifying tube that permits an even spread of moisture on each side of a cigar for up to six months without drying out thanks to the twin chamber system in the tube. The present invention also allows the recovery of dried cigars. Apart from the humidifying role, the invention provides an advertising opportunity since cigars stored in it can be viewed from the outside.

4 Claims, 12 Drawing Sheets

TWIN CHAMBER HUMIDIFYING TUBE

RELATED APPLICATION

The present application is a Continuation in Part of U.S. Ser. No. 12/046,927, which is incorporated herein in its entirety by reference.

FIELD OF THE INVENTION

The invention applies to the manufacturing of various articles and accessories in the Tobacco Industry and Smokers alike.

BACKGROUND OF THE INVENTION

Cigars also known as "puros" or by its place of origin "habanos" are cigars made from rolled tobacco leaves without the use of wrapping paper.

The main place of origin of cigars is Cuba, a country in which apart from its lands, special weather conditions such as temperature and humidity take place.

Cigar Smoking requires certain tobacco conditions to be able to sense its organic features specially the aroma as well as to be able to consume it trouble free and effortless.

However, exporting and consuming cigars in different parts of the world other that the place of origin where environmental conditions such as temperature and humidity differ from the latter, requires appropriate protection during the process of transport and storage at the tobacconists prior to be purchased by the final consumer as well as the consumer itself.

Tobacco shops would normally be fitted with big humidors (whether a room or furniture) providing special conditions of temperature and humidity.

On the consumer side the industrial approach of building a room or buying furniture to keep cigars becomes unsuitable, therefore preserving cigars would require the use of smaller humidors such as a wooden box type furniture with a humidifying system, consisting of a wet sponge that would keep suitable conditions of Cigars prior to consumption. This system requires periodical water replacement and for that the system includes a hygrometer indicating the humidity level inside.

Additionally, certain types of portable humidors are in use by consumers when carrying cigars from their homes to a different place of consumption. These small sized leather cases generally allowing 1 to 3 cigars do not contain a humidifying system as such, although a few improvements has been done the matter. The effectiveness of these portable items lie on the leather isolation preventing or delaying the cigar to get dry therefore these shall not be considered as humidors as such. Samples of these improved items can be found under U.S. Pat. No. 6,112,889 or Utility Model 9900653 or under U.S. Pat. No. 5,832,934.

U.S. Pat. No. 5,832,934 consists of a portable cigar humidifying device, joined in two sections, lower and upper sections, with a guillotine cigar cutter attached on top of the upper section. The device contains a humidifying device consisting of a storage area of adequate size inside the upper section, in which a sponge previously wet is introduced in the storage area and via which humidity is transpired thru small holes.

However, U.S. Pat. No. 5,832,934 does not claim a double chamber humidor and provides certain inconveniences typical of these type of humidors such as placing the humidifying device to one end of the humidifying tube, unable to be completely watertight, lack of a double chamber system and last but not least requiring the opening of the cigar compartment in order to replace the humidifying liquid. Also, the patent presents the humidifying device at one end, which destroys the cigar due to uneven humidifying effect. Besides that, the device is not built with a double chamber allowing perfect cigar wetting and it is not watertight, thus producing variable humidity and requiring replacement of the liquid. Further, the user must open the cigar container to check humidity level, therefore reducing the appropriate level of such parameter.

On the other hand, portable cigar tubes or personal cigar holders can be found with a humidification system on one end consisting on a sponge releasing humidity inside the tube. Although these devices provide humidity to cigars, they do not guarantee ideal levels of humidity for correct cigar conservation. An example of such device is represented by U.S. Pat. No. 5,957,277 or Utility Model 8601104.

Also, U.S. Pat. No. 5,850,839 describes a cigar flavoring device, consisting of an external transparent and tight housing plus a humidifying device. Inside the external housing an internal housing is found to place cigars, half the length of the external housing and smaller in perimeter compared to the outer housing. Beneath the inner housing a humidifying device is placed with a sponge or similar item on a multiple orifice surface. This section beneath the inner housing is solid, thus preventing humidity released by the humidifying device to reach the inner side of cigars. Humidity drains thru the hole left in the tray where cigars rests and the walls of the outer housing, so as to create a uniform flavoring process for the cigars.

This patent, however, lacks a double chamber device, so that U.S. Pat. No. 5,850,839 as well as U.S. Pat. No. 5,957,277 or Utility Model 8601104 with a sponge as a source of humidity in one end, destroys cigars due to the unequal humidification. The concentrated and excessive levels of humidity on one of the cigar, produces swelling in this end of the cigar, as well as creating a humidity defect on the rest of the cigar. Considering that U.S. Pat. No. 5,850,839 is not an actual humidor, but a flavoring device, the harmful effect over cigars is identical, since the height of each side of the tray where the cigars rest only prevents aroma and humidity from directly reaching the cigar base. Thus, there is an uneven flavoring and humidification of cigars.

The optimum conditions for cigar preservation are temperatures between 18-22 degrees Celsius in a 65-75% humidity level environment, with an even and gentle yet slow moisturizing process all around the cigar to avoid destruction due to excess of humidity.

So, to prevent humidification issues typical with these known portable tubes, the present application describes a double chamber humidifying tube, supplying gentle, steady, and even humidity thanks to its double chamber, allowing dried cigars to recover. Keeping appropriate humidity levels require only replacing water as the sponge dries up, without prior verification of water level or constant opening of the cigar container.

Also, the upper transparent section allows visual inspection of the cigars, the ring and the cigar brand, representing in overall a new development unknown till today with many advantages on its marketing and advertising functions. Although U.S. Pat. No. 5,850,839 details a transparent container, the device holds a few inconveniences such as a complete cigar exposure that may be harmed by sunlight and purposes since its goal is the observation of number of cigars contained and the flavoring process, but not necessarily expressing the level of flavoring.

SUMMARY OF THE INVENTION

The present application seeks to provide a twin chamber humidifying tube for maintaining adequate humidity in cigars allowing an even process for moisturizing cigars sideways and also reviving dried cigars and visualizing the cigar contained in it, comprising: (a) a cylindrical external structure, consisting of an air tight container outer tube having a (1) first sub-section (1*a*) and a second sub-section (1*b*); (b) an inner cylindrical structure formed by an inner tube (4) having an upper side and a lower side, and of a diameter slightly smaller than the diameter of the outer tube and of a length a half of the length of the outer tube, placed inside the second sub-section, the inner tube having multiple via vents (22, 22*a*, 22*b* and 22*c*) along a perimeter of the inner tube, consisting of a less number of vents in the lower side and an increased number of vents in the upper side; the inner cylindrical tube defining an inner chamber (24) containing a cigar; (c) a middle chamber (23) defined between the air tight container outer tube (1) and the inner tube (4), enabling drained humidity (27) to penetrate in the inner chamber (24), and (d) a tight container (20) located in inner tube (4) to accommodate a humidifying device (2), the humidifying device consisting of a sponge (13) placed in an inner container (11) with vents (12) for humidity exhaust), and a cap (9). The air tight container outer tube (1) and the inner tube (4) are amicably assembled in the second sub-section (1*b*); and the first sub-section (1*a*) and the second sub-section (1*b*) joined by a washer (6) and a thread or pressure closure system (7 and 8) in the air tight container outer tube (1) allowing watertight closure of the twin chamber humidifying tube as a whole.

DESCRIPTION OF THE INVENTION

Figure 1:
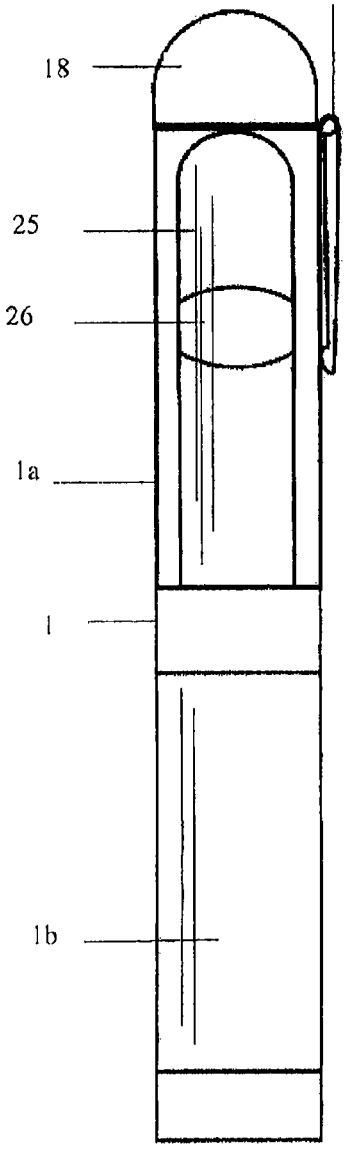
FIG. 1 shows an elevational view of the present invention in its final configuration.
Figure 2:
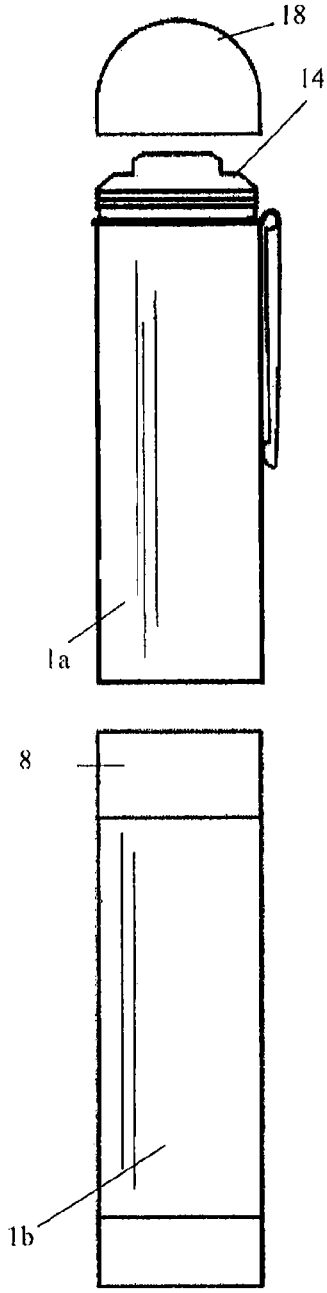
FIG. 2 shows an elevational view of the present invention in FIG. 1, separating the upper and lower sections and the watertight cap.
Figure 3:
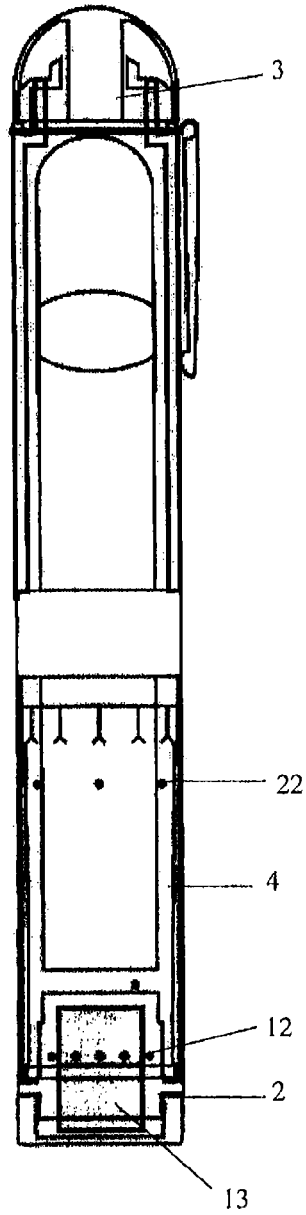
FIG. 3 shows a sectional view of the present invention in its final configuration with inside details.
Figure 4:
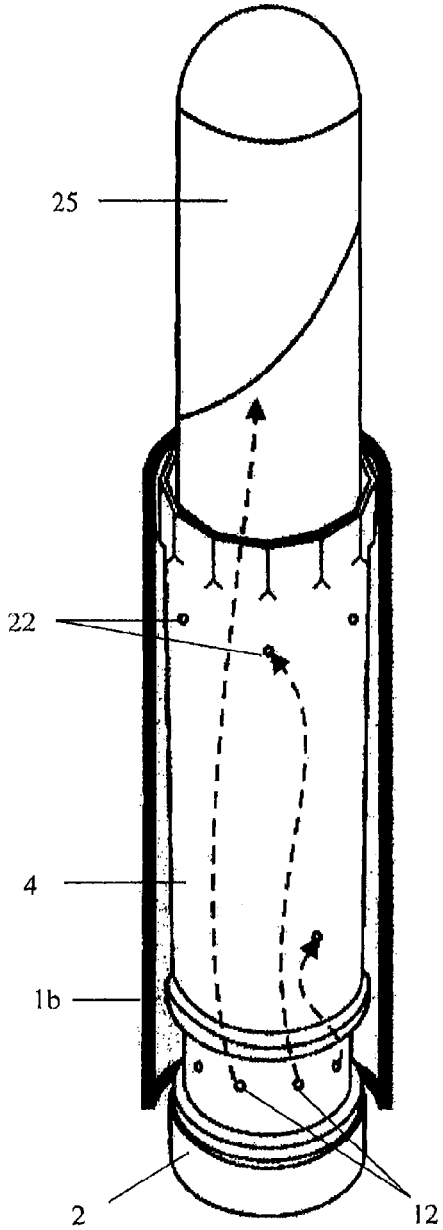
FIG. 4 shows a three-dimensional view of the lower section, detailing the humidity path and functioning of the humidifying system.

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

The twin chamber humidifying tube that this application describes is undoubtedly a practical solution enabling an even moisturizing process on cigars, allowing a uniform and gradual spread of humidity of cigars.

An even or uniform moisture keeps a cigar inside a tube up to six months without drying out inside plus the slowness and gradual humidification permits enlarging the time required to keep proper humidity and preservation of the cigar. This momentum is thanks to the result of a long journey performed by the humidity beginning from the sponge to the inside of the cigar, having this thick humidity pass through various walls, chambers and vents before entering the inner chamber where the cigar rests.

Also due to a visible transparent upper section, the present invention allows the user to visualize the cigar contained in it, the ring (vitola) and the cigar brand providing advertising opportunities.

As illustrated in FIGS. 1-9, the twin chamber humidifying tube of the present application comprises: an outer cylinder shaped structure (or rectangular shaped) formed by an air tight container tube or exterior tube (1) divided in two subsections (1*a*) and (1*b*), a humidifying device (2) and a cigar cutter (cap type); and an inner cylinder shaped structure formed by an inner tube (4) slightly smaller in diameter than the outer tube (1) and half of the outer tube's length (1).

The outer tube (1) has a transparent upper section (1*a*) with thread or pressure system (5) located on the upper edge to hold the cigar punch or cutter (3) and a pressure washer (6) on the lower edge to joint the inner section (1*b*), in the lower edge of the inner section (1*b*) the humidifying device (2) is attached. At the same time the lower edge of the upper section (1*a*) holds a thread or pressure system (7) to fix both sections (1*a*) and (1*b*) between themselves via washer (6) for which the upper edge of the lower section (1*b*) has a thread or pressure system (8).

A water tight container (20) accommodates the humidifying device (2), which is located in inner tube (4) and consists of a sponge (13) placed in an inner container (11) with vents (12) for humidity exhaust, and a cap (9), (a watertight cap) fixed to the watertight deposit (20). Vents (12) allow humidity to escape and the sponge (13) soaked in water, which will loosen the water to moisturize the cigar.

The position of humidifying device (2) being located in the watertight deposit (20), allows water refilling of sponge (13) without the need of opening the humidifying tube and consequently exposing the cigars, thus the humid environment is not affected and the cigar aroma is preserved inside the tube.

The cigar punch or cutter (3) is formed by a cap type cutter (14) held by threads or pressure system (15) fixed to the upper section (1*a*) or the outer tube (1). A rubber washer (16) or similar device and a clip (17) are disposed between a cap (18) and the pressure system (15). The washer (16) covers threads of the pressure system (19).

Figure 13:
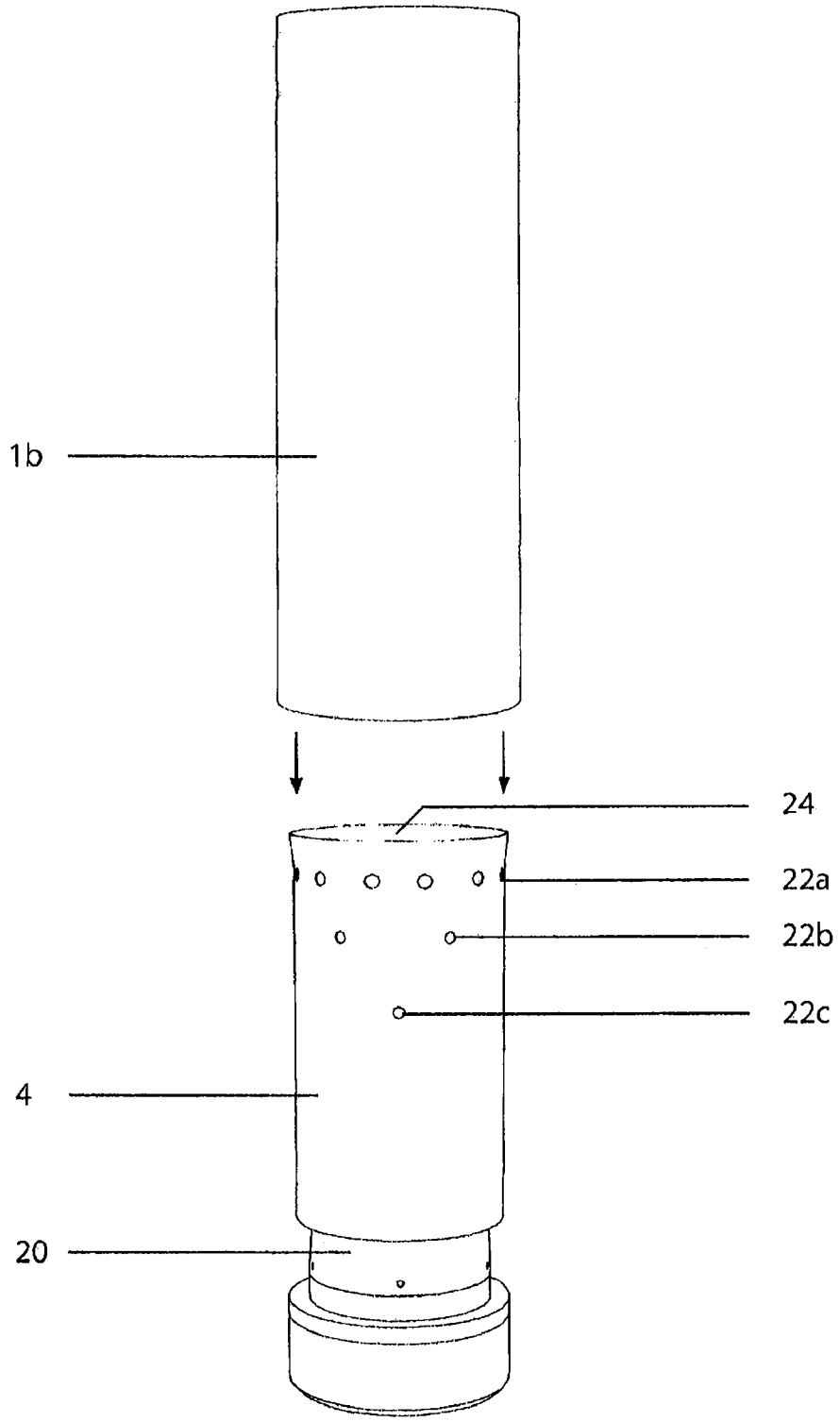
FIG. 13 shows the double chamber device dismantled with inner section of the outer tube, inner tube, vents and the sealed container.

As shown in FIG. 13, the inner tube (4) which is half of the size of the outer tube (1) as on its base a watertight holder (20) for introducing the humidifying device (2) through a thread or pressure system (21) and a series of vents spread evenly throughout the entire perimeter (22) of the tube allowing the penetration of humidity exhausted by sponge (13), then out to the humidifying device (2) through existing vents (12) to moisturize cigar (25) resting inside of it. A number of vents (22) are placed in such a way that a lesser number of vents (22*c*) are in the lower side. The number and caliber of vents are higher in middle (22*b*) and even greater and larger vents at the upper end (22*a*) to obtain a uniform humidification.

It is necessary to decrease the number of vents (22) in the inner tube (4) close to the watertight container (20) so that humidity slows down into the lower area close to sponge (13). While caliber and number of vents increase in the inner tube (4) because of being close to the watertight container (20), such effect produces a higher humidity demand in the upper zone and consequently pushes a column of humidity over the upper zone of the cigar.

As described above, the outer tube (1) contains on its lower section (1*b*) the inner tube (4) and both tubes, outer (1) and inner (4), are amicably joined together in the said lower section (1*a*) and both sections, upper and lower, are joined together via a thread or pressure system (7 and 8) and washer (6) on the outer tube (1) providing a watertight fixture of the whole.

Assembled together and with the humidifying tube completely mounted between the outer tube (1) and inner tube (4), humidity (27) drains out from sponge (13), escapes through vents (12), crosses said chamber and penetrates the second chamber (24) formed by the inner space of the inner tube (4) where cigar (25) lies.

In this way humidity from sponge (13) does not directly reach the cigar's lower edge (25), but rather, it has to spread along chamber (23), then inside chamber (24) through the provided vents resulting in an even moisturizing process of the cigar. A perfect and balanced equilibrium of humidity keeps cigars for up to six months, without replenishing the humidifying device (2) in container (20).

The double chamber system described can be applied to personal humidifying tubes as well as multiple humidifying containers in which various numbers of cigars can be laid for humidification and conservation.

Since the upper section (1*a*) of the outer tube (1) is transparent, cigar (25) lying inside can be seen with vitola and brand (26).

Figure 5:
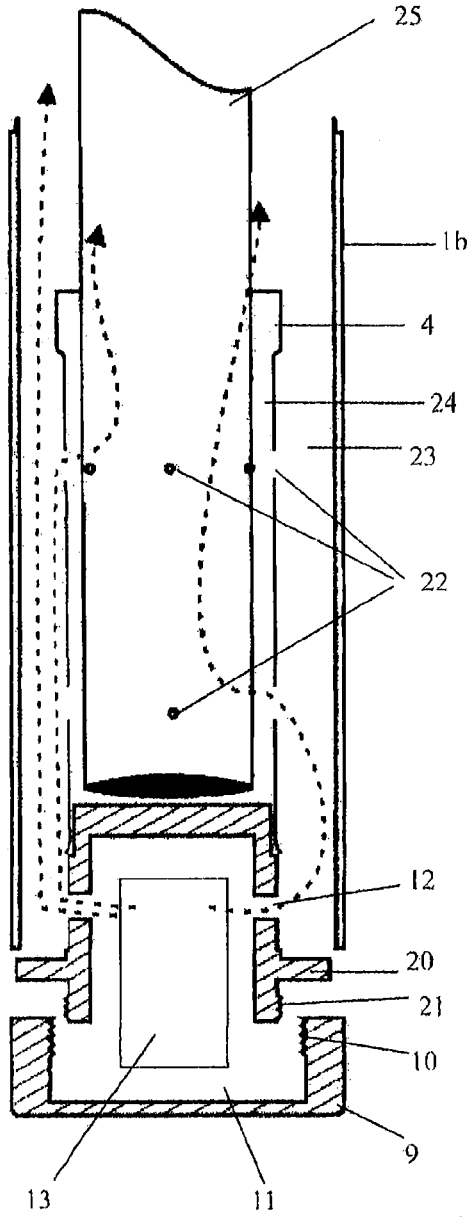
FIG. 5 shows a sectional view of the humidifying system functioning.
Figure 6:
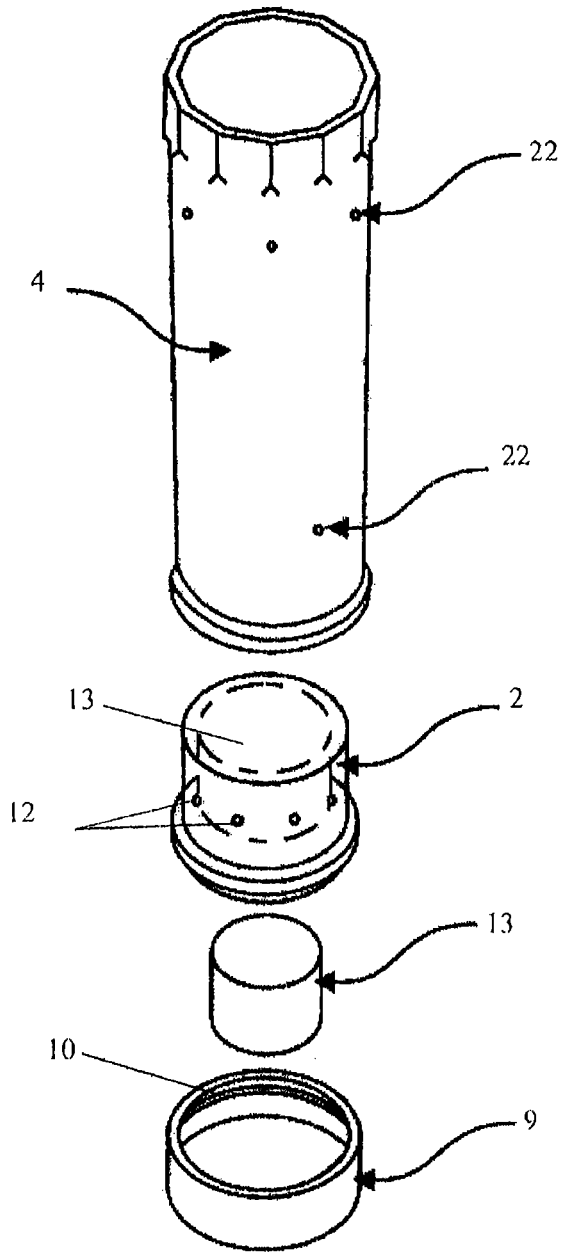
FIG. 6 shows a three-dimensional dissembled view of the inner tube and humidifying system.
Figure 7:
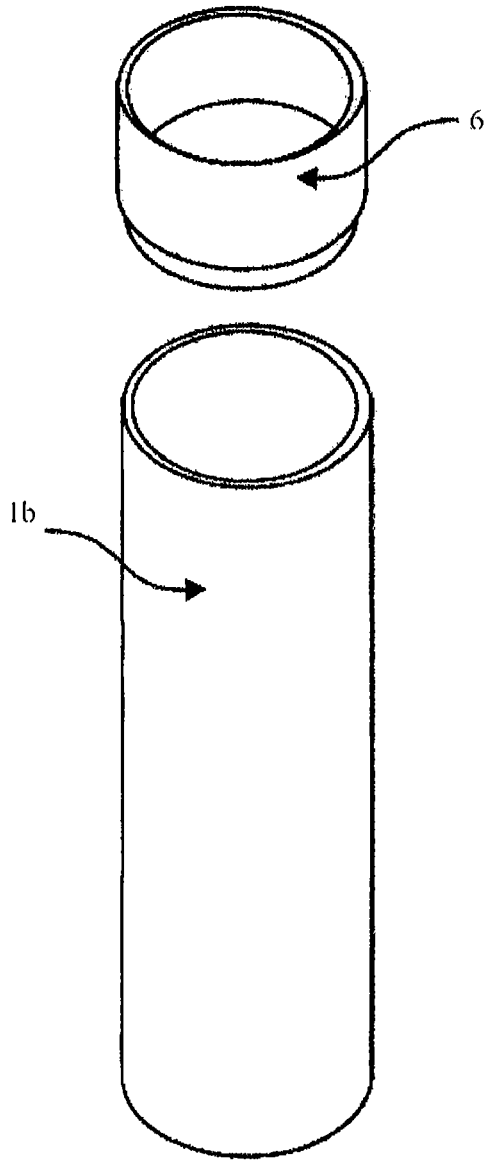
FIG. 7 shows a three-dimensional dissembled view of the lower section of the outer tube.
Figure 8:
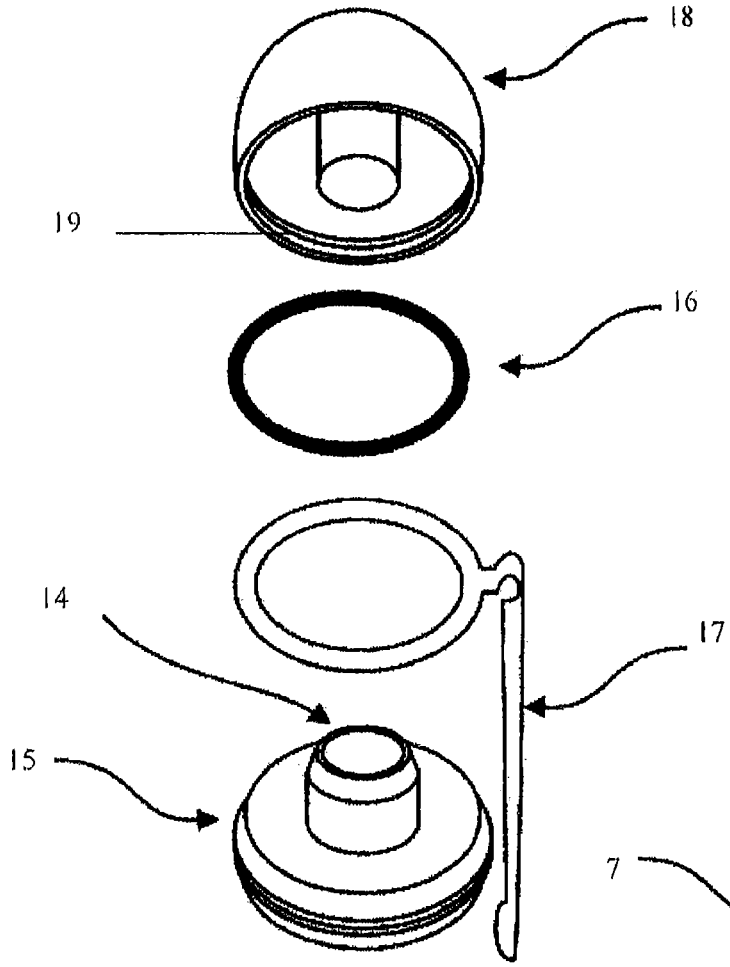
FIG. 8 shows a three-dimensional dissembled view of the cigar punch (cutter).
Figure 9:
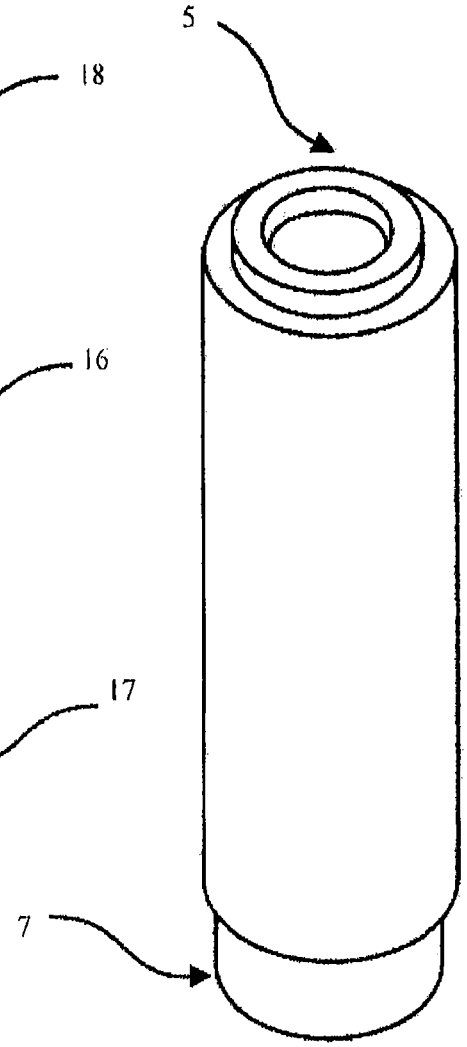
FIG. 9 shows a three-dimensional dissembled view of the upper section of the outer tube.
Figure 10:
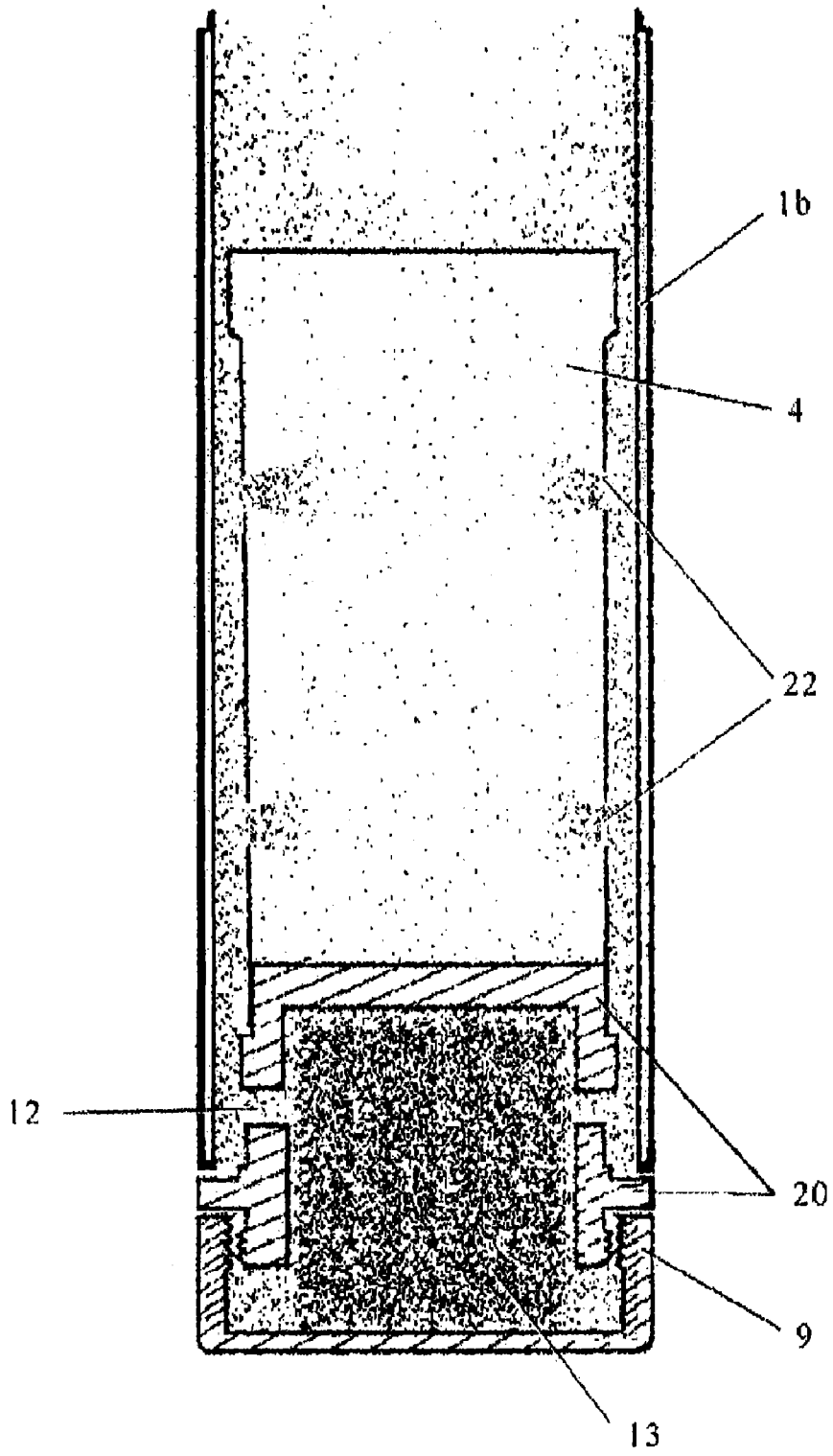
FIG. 10 shows the humidity path from source or sponge through the twin chamber formed by cylinder or outer tube and cylinder or inner tube till its penetration into chamber via vents to humidify the cigar.
Figure 11:
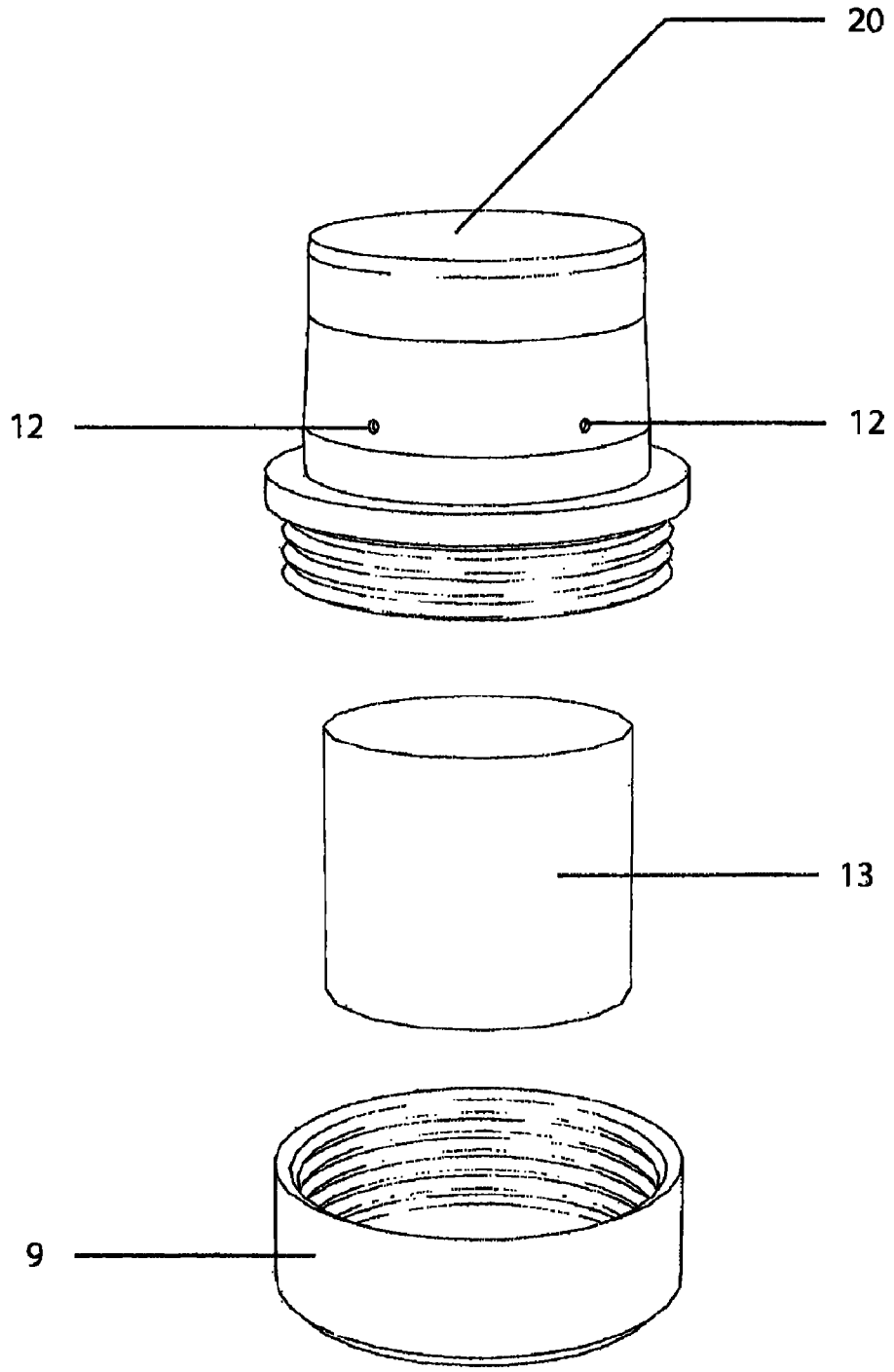
FIG. 11 shows the humidifying device dismantled, showing the watertight container, sponge, exhaust vents and cap.
Figure 12:
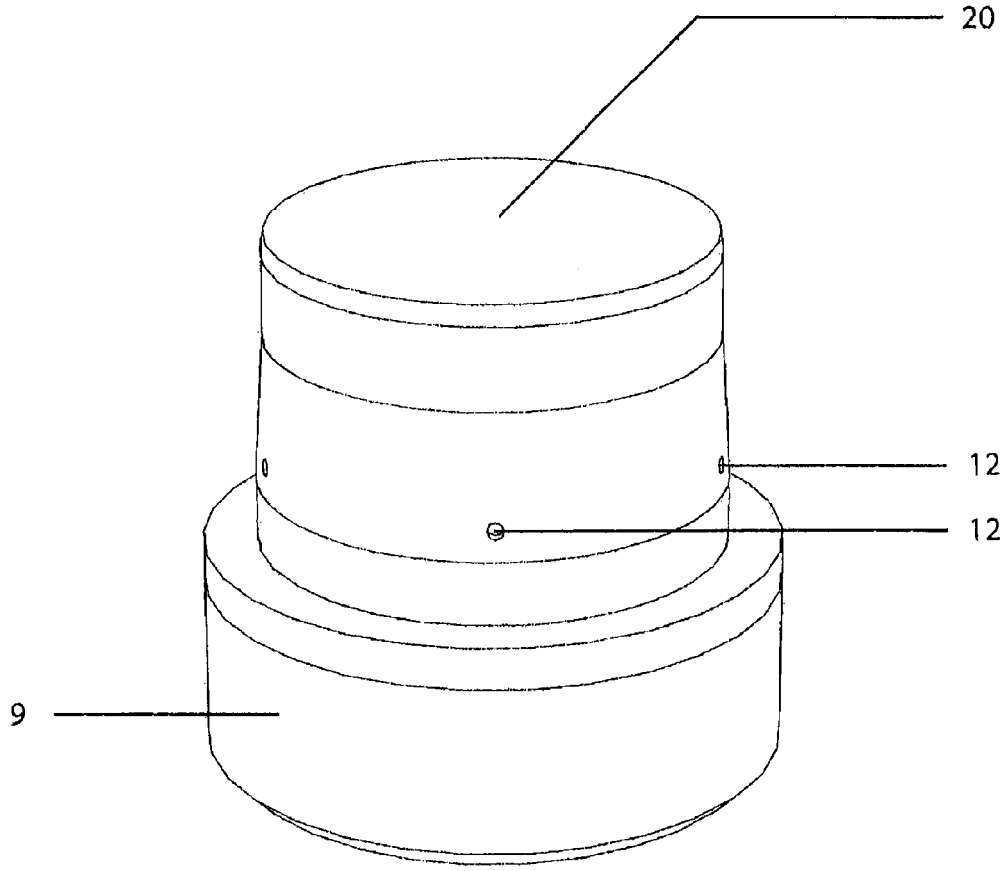
FIG. 12 shows an assembled humidifying device.

FIG. 5 describes the humidity path from source or sponge (13) through twin chamber (23) formed by cylinder or outer tube (1*b*) and cylinder or inner tube (4) till its penetration into chamber (24) via vents (22) to moisture cigar (25) lying inside.

Figure 14:
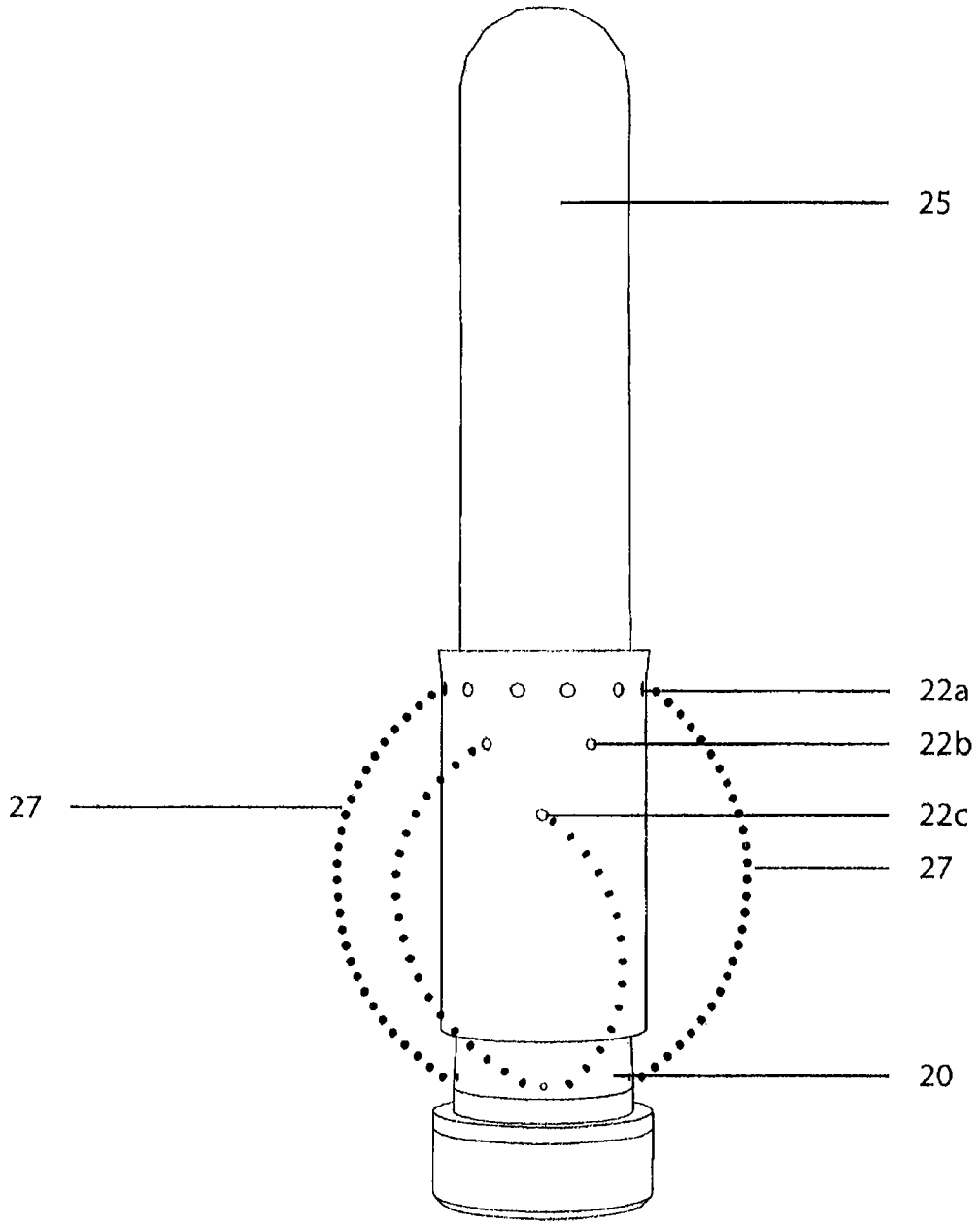
FIG. 14 shows the functioning of the double chamber and humidity path thru the exhaust vents.
Figure 15:
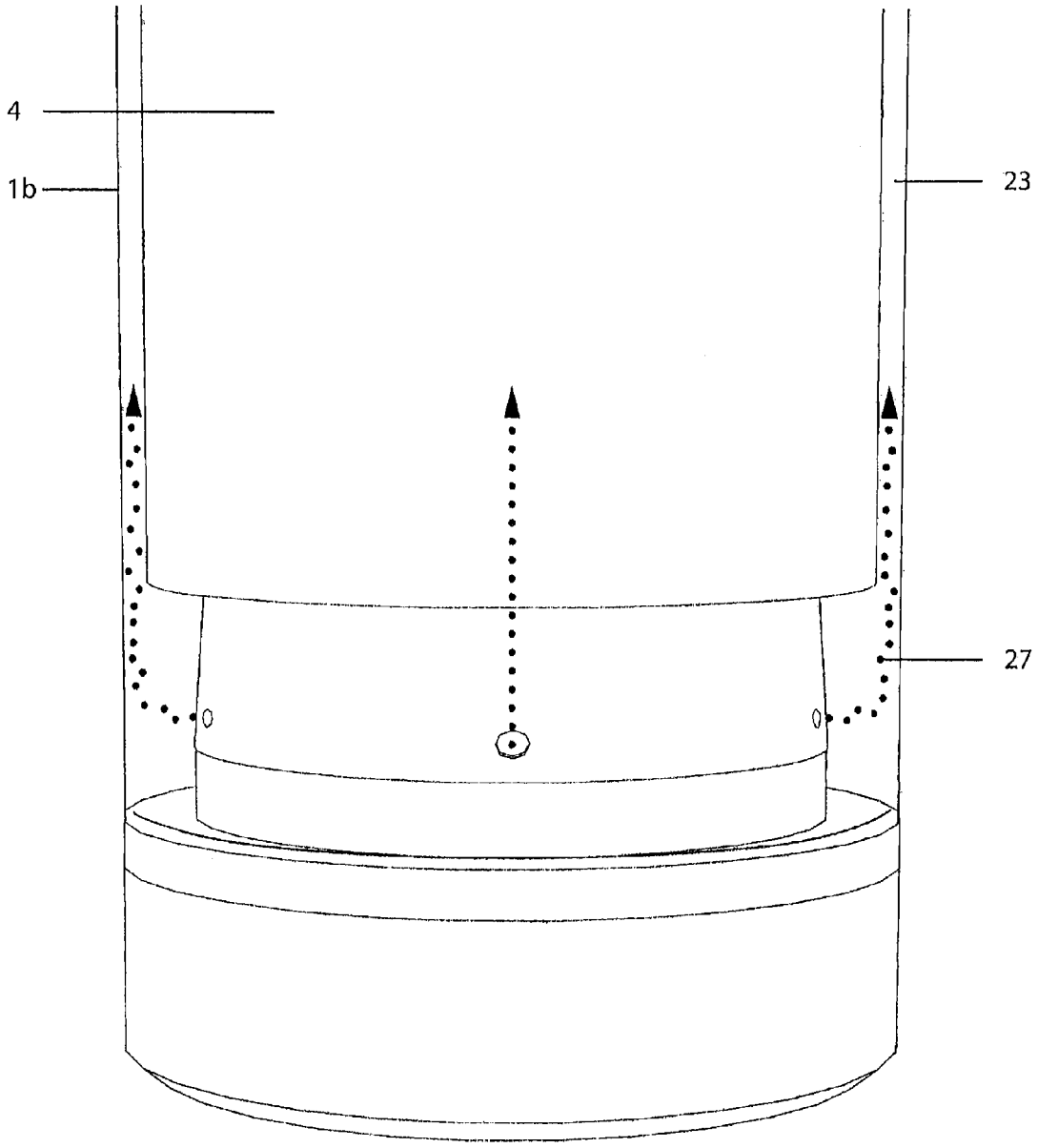
FIG. 15 shows the out going humidity from the humidifying device thru vents via the middle chamber.
Figure 16:
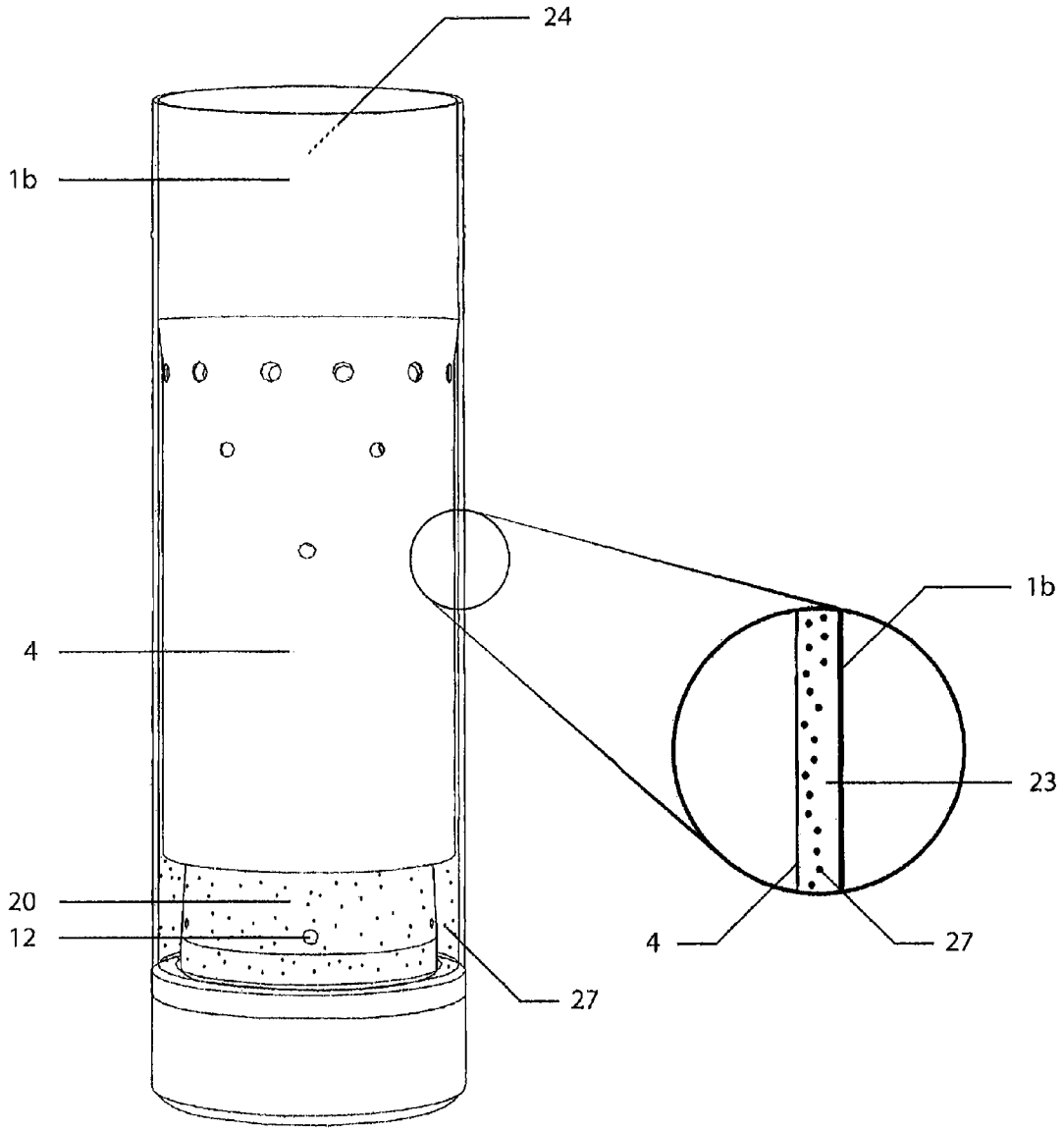
FIG. 16 shows the combined functioning of FIGS. 14 and 15.
Figure 17:
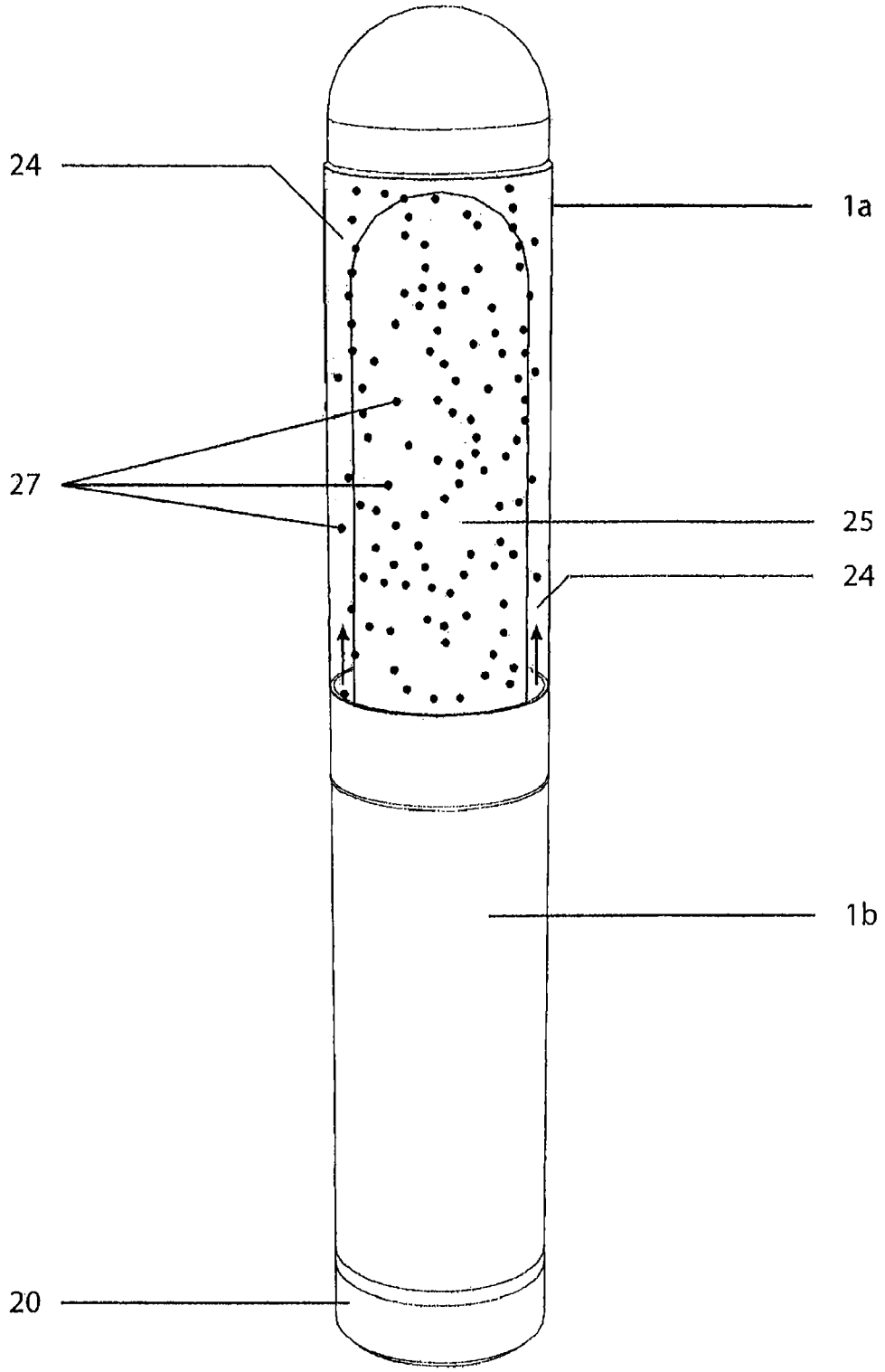
FIG. 17 shows the even distribution of humidity on the superior side of the humidifying tube to the entire cigar.

In FIG. 14, the discontinued lines describe the humidity path through the exhaust vents. FIG. 15 describes the outcoming humidity from the humidifying device through vents (12) via the middle chamber. In FIG. 17 it is possible to see the even distribution of humidity on the superior side of the humidifying tube to the entire cigar.

Finally, considering the slow and uniform moisturizing process that this twin chamber mechanism provides, dried cigars due to poor or inappropriate preservation can be revived, since the existence of the twin chambers permits the absorption of humidity expelled by the sponge thru the vents of the inner tube till required level of humidity is gained due to chemical balance between humidity and remains of water in the sponge. In other words, the cigar acts as a slow absorber lying with the sponge through the twin chambers, an advantage that causes the water to be absorbed gradually and avoiding the cigar to be destroyed.

The following charts illustrate maintenance and recovering data from cigars using the humidifying tube, subject of the present invention.

CHART 1

Maintenance of a Cigar as Per Weight (Grams)

The cigar introduced in the tube has been previously adequately humidified.

| | Cigar 4 to 10 g | Cigar 10 to 15 g | Cigar 16 to 20 g |
|---|---|---|---|
| 100 percent wet sponge | 10 months | 7.5 months | 5 months |
| 50 percent wet sponge | 6 months | 4.5 months | 3 months |

CHART 2

Cigar Recovery as Per Weight (Grams)

| | Cigar 6 to 12 g | Cigar 12 to 18 g | Cigar 18 to 24 g |
|---|---|---|---|
| 100 percent wet sponge | 6 months | 4.5 months | 3 months |
| 50 percent wet sponge | 4 months | 3 months | 2 months |

EXAMPLE 1

In a preferred embodiment, the twin chamber humidifying tube consists of two sections, upper-formed only by the outer transparent tube (1) and lower-formed by the outer tube (1) and the inner tube (4).

Prior to introducing cigar (25), pressure is applied to untwist watertight cap (9) from the humidifying device (2), inner container (11) with sponge (13) is extracted, sponge (13) is soaked in water and the sponge (13) and inner container (11) are then put back onto the watertight container (20) on the inner tube (4) base using pressure (21). Cap (9) is then again twisted with thread or pressure system (10) and then fixed to the lower section (1*b*) of outer tube (1). During this operation, the opening of the tube where the cigar sits is not required.

Once water has been replaced, both sections are separated from the humidifying tube pressing system (6, 7 and 8) in the outer tube (1), and then cigar (25) is placed inside chamber (24) formed by the inner space of the inner tube.

Once cigar (25) is placed inside, the user closes both sections by pressing system (6, 7 and 8) allowing a tight closure of the whole. To accomplish this, both tubes: outer (1) and inner (4) are joined amicably.

The humidifying device (2) operates with sponge (13) exhausting gradually humidity (27) from absorbed water, leaving inner container (11) through the vents (12), spreading along chamber (23) space formed between outer tube (1) and inner tube (4) diameters, penetrates into second chamber (24) where cigar (25) lies, formed by the inner space of inner tube (4), through a series of vents evenly distributed along perimeter (22, 22*a*, 22*b* and 22*c*).

This way, humidity from sponge (13) will reach indirectly to the lower edge of cigar (25), dispersed along the axis of chamber (23) to penetrate chamber (24) through different vents and resulting on an even moisturizing process of cigar (25) lying inside.

An adequate level of humidity is obtained during the cigar conservation by only extracting the humidifying system (2) to replace water in the sponge (13) periodically without the need of opening the cigar container tube.

The whole is designed to allow pocket transportation with the help of clip (17).

On the other hand, the outer tube (1) transparent section (1*a*) permits viewing of the cigar vitola and brand from the outside.

When the moment comes to consume cigar (25) its only a matter of opening the whole, split the two sections via system (7 and 8) and extract the cigar.

This is the time when the cigar end needs piercing before been smoked. Cap (18) covering the cigar punch or cutter is removed after pressing system (19). The cigar is cut with the help of the cutter (14) included in the invention. The cigar punch (14) can also be used on any other cigar.

EXAMPLE 2

In a second preferred embodiment of the present application, the twin chamber humidifying tube is used for cigar (25) recovery. Taken into consideration the gradual and equal humidification of this mechanism with a double chamber, dried cigars can be recovered.

For this reason, the twin chamber (23 and 24) system operates in a way that when a dried cigar is introduced in the tube, it absorbs humidity from the sponge through the vents or holes of the inner tube till the required balance of moisture is gained between the humidity as such and the water remaining in the sponge. In other words, the cigars is a slow absorber of water from the sponge using the twin chambers. The invention has as an advantageous fact that water is not absorbed promptly, otherwise destruction of cigar occurs.

The invention claimed is:

1. A twin chamber humidifying tube for maintaining adequate humidity in cigars allowing an evenly process for moisturizing cigars sideways and also reviving dried cigars and visualizing the cigar contained in it, comprising:

(a) a cylindrical external structure, including an air tight container outer tube having a first sub-section and a second sub-section;

(b) an inner cylindrical structure formed by an inner tube having an upper side and a lower side, and of a diameter slightly smaller than the diameter of the outer tube and of a length a half of the length of the outer tube, placed inside the second sub-section, the inner tube having multiple via vents along a perimeter of the inner tube, consisting of a less number of vents in the lower side and an increased number of vents in the upper side; the inner cylindrical tube defining an inner chamber containing a cigar;

(c) a middle chamber defined between the air tight container outer tube and the inner tube, enabling drained humidity to penetrate in the inner chamber, and (d) a watertight container, located in the inner tube to accommodate a humidifying device, the humidifying device consisting of a sponge placed in a inner container with vents for humidity exhaust, and a cap, wherein the air tight container outer tube and the inner tube are amicably assembled in the second sub-section; and the first sub-section and the second sub-section are joined by a washer and a thread or pressure closure system in the air tight container outer tube allowing watertight closure of the twin chamber humidifying tube as a whole.

2. The twin chamber humidifying tube according to claim 1, further comprising a cigar cutter, adjacent to an upper edge of the first sub-section.

3. The twin chamber humidifying tube according to claim 1, wherein the first sub-section of outer tube is transparent, enabling the view of the vitola and the brand of the cigar contained in it.

4. The twin chamber humidifying tube according to claim 1, further including a clip located adjacent to an upper edge of the first sub-section.

* * * * *